US010842236B2

(12) United States Patent
McMichael

(10) Patent No.: US 10,842,236 B2
(45) Date of Patent: Nov. 24, 2020

(54) WALKING CANE THAT FOLDS INTO A PORTABLE CHAIR

(71) Applicant: Jeffrey S. McMichael, Atlanta, GA (US)

(72) Inventor: Jeffrey S. McMichael, Atlanta, GA (US)

( * ) Notice: Subject to any disclaimer, the term of this patent is extended or adjusted under 35 U.S.C. 154(b) by 103 days.

(21) Appl. No.: 15/911,205

(22) Filed: Mar. 5, 2018

(65) Prior Publication Data

US 2018/0249796 A1 Sep. 6, 2018

Related U.S. Application Data

(60) Provisional application No. 62/466,906, filed on Mar. 3, 2017.

(51) Int. Cl.

| | |
|---|---|
| ***A47B 5/00*** | (2006.01) |
| ***A45B 5/00*** | (2006.01) |
| ***A47C 4/28*** | (2006.01) |
| ***A47C 4/44*** | (2006.01) |
| ***A61H 3/00*** | (2006.01) |
| ***A47C 4/30*** | (2006.01) |
| ***A61H 3/02*** | (2006.01) |
| *A45B 9/00* | (2006.01) |

(52) U.S. Cl.

CPC ..... *A45B 5/00* (2013.01); *A47C 4/286* (2013.01); *A47C 4/30* (2013.01); *A47C 4/44* (2013.01); *A61H 3/00* (2013.01); *A61H 3/02* (2013.01); *A45B 2009/005* (2013.01); *A61H 2201/0161* (2013.01)

(58) Field of Classification Search

CPC ..... A45B 5/00

USPC ..... 297/16.2, 35, 45

See application file for complete search history.

(56) References Cited

U.S. PATENT DOCUMENTS

| | | | | |
|---|---|---|---|---|
| 617,661 A * | 1/1899 | Smith | A45B 5/00 297/18 |
| 1,089,295 A * | 3/1914 | Vallier | A45B 5/00 248/155.1 |
| 1,942,112 A * | 1/1934 | McQuilkin | A47C 4/286 297/45 |
| 2,629,429 A * | 2/1953 | Baumfeld | A47C 9/105 297/58 |
| 2,742,956 A | 4/1956 | Cannata | |

(Continued)

FOREIGN PATENT DOCUMENTS

| | | |
|---|---|---|
| CN | 104544814 A | 4/2015 |
| CN | 107455867 A | 12/2017 |

(Continued)

OTHER PUBLICATIONS

Freshore Cane Seat; Listed Patent Number (Unable to Locate): ZL 2015 2 0816980.2 Earliest Date Found Selung: September 1, 2017.

*Primary Examiner* — Sarah B McPartlin

(57) ABSTRACT

A multi-legged foldable cane chair with a folding geometry such that the members fold into a cane-like shape and unfold into a chair-like seat. The members and braces are joined such that one rear leg, one front leg, one armrest, and one seat bar comprise one side of the cane chair, while a rear brace and front brace separate the sides of the chair, and a seat and backrest provide areas for the user to sit and relieve weight. A handle provides a hand grip if the cane chair is used as a walking or standing aid.

7 Claims, 5 Drawing Sheets

(56) References Cited

U.S. PATENT DOCUMENTS

| | | | | | |
|---|---|---|---|---|---|
| 2,766,813 | A | * | 10/1956 | Kay | A47C 15/004 297/54 |
| 2,798,536 | A | * | 7/1957 | Shew | A47C 9/105 248/155.2 |
| 3,968,991 | A | * | 7/1976 | Maclaren | A61G 5/08 297/45 |
| 4,714,201 | A | * | 12/1987 | Rouse | B03B 9/061 241/24.14 |
| 5,188,422 | A | | 2/1993 | Montgomery | |
| D338,345 | S | | 8/1993 | Camp | |
| 5,426,796 | A | * | 6/1995 | Stanton | A47C 17/22 5/12.1 |
| D396,569 | S | | 8/1998 | Chen | |
| 6,899,388 | B1 | * | 5/2005 | Enrique | A47C 7/66 297/129 |
| 7,000,938 | B2 | * | 2/2006 | Watkins | B62B 7/08 280/642 |
| 7,219,679 | B2 | | 5/2007 | Hsu | |
| 7,316,449 | B2 | | 1/2008 | Lynch | |
| 8,876,203 | B1 | | 11/2014 | Haertl | |
| 9,681,713 | B2 | | 6/2017 | Pao | |
| 9,854,882 | B1 | | 1/2018 | Peck | |

FOREIGN PATENT DOCUMENTS

| | | | |
|---|---|---|---|
| FR | 2665344 | A1 | 2/1992 |
| JP | 2014039812 | A | 11/2015 |
| KR | 101439955 | B1 | 9/2014 |

* cited by examiner

WALKING CANE THAT FOLDS INTO A PORTABLE CHAIR

CROSS-REFERENCE TO RELATED APPLICATIONS

This application claims the benefit of U.S. Appl. Ser. No. 62/466,906 filed Mar. 3, 2017, the entirety of which is incorporated herein by reference.

BACKGROUND

Embodiments of the present disclosure relate to folding chairs, and more particularly to folding chairs that can be used as a walking cane. Walking canes allow the elderly, disabled, hikers, outdoor enthusiasts, etc. to be assisted in walking or standing. Conventional single-purpose walking canes; however, do not allow the user to sit on the cane to relieve weight and discomfort from sedentary or moving activities. So-called cane chairs have the form of a walking cane while also providing a seat, allowing the user to support a portion or all their weight on the attached chair or seat.

Current cane chairs have one or more legs for support. Multi-legged cane chairs U.S. Pat. Nos. 6,899,388, 9,681,713, and U.S. Pat. Des. No. 338,345 are examples of latter category. The orientation and height of the unfolded legs of the cane chairs referenced create a small base where the legs meet the floor, and a seat of a similar size. Additionally, the seat is high off the ground, which make stability and extended comfort for the user difficult. Furthermore, using these cane chairs requires continued assistance from the user for balance. For the elderly and disabled, this is often not possible, and the required dexterity leads to falls and accidents.

Single-legged cane chairs are shown in U.S. Pat. Nos. 7,316,449 and 5,188,422. Being even more difficult to sit on than multi-legged cane chairs, these cane chairs place the seat at the top of the cane near the handle, or using the handle as the structure for the seat. By placing the seat at this height, the user's legs act as the other two legs of a tripod. With the center of mass higher than in the multi-legged variants, the user is more prone to tipping over while using. The lea strength required is also prohibitive.

Aside from being difficult and dangerous to use, these cane chairs are also bulky in appearance and form. Legs and appendages may stick out from the typical slender walking cane shape, and their presence clash with the image and use of conventional single-purpose walking canes. The unfolded seats are equally cumbersome in shape and functionality.

In current industry use, the Freshore Cane Seat has the form of a chair, but when folded appears closer to a collapsed camp chair than a walking cane. Overall, the previous attempts to create a multi-purpose cane chair do not address the idea of a walking cane that can be used both as a cane and as a fully-functional chair.

BRIEF SUMMARY

In accordance with one embodiment, a cane chair comprises a multi-legged folding chair with a seat, back rest, arm rests, and handle.

Accordingly, several advantages of one or more aspects are as follows: to provide a walking cane whose structural members can be unfolded into a seat, has a back rest, has arm rests, has a handle, creates a stable base, is relatively lightweight, functions as a walking cane when folded, functions as a chair when unfolded, can be easily carried, is stable as a walking cane, is stable as a chair, and supports the weight of a user comfortably for a prolonged period. Other advantages of one or more aspects will be apparent from a consideration of the drawings and ensuing description.

DETAILED DESCRIPTION

Some embodiments of the present disclosure will now be described more fully hereinafter with reference to the accompanying figures, in which some, but not all embodiments of the disclosures are shown. Indeed, these disclosures may be embodied in many different forms and should not be construed as limited to the embodiments set forth herein; rather, these embodiments are provided so that this disclosure will satisfy applicable legal requirements. Like numbers refer to like elements throughout.

EXEMPLARY DEFINITIONS

2: rear legs—Rear structural members of cane chair.

4: pivot bracket—Bracket(s) attached to rear legs around which the bracket pins are attached.

6: bracket pin—Locating piece attached to or through the pivot bracket(s) around which the seat bars pivot.

8: seat bar—Structural member that forms a connection between the rear legs and front legs, connecting point for seat.

10: seat pin—Locating piece attached to or through the front legs and seat bars to allow a pivoting motion.

12: front leg—Front structural members of cane chair.

14: foot—Piece attached to front legs and/or rear legs between the legs and the floor surface.

16: handle pin—Locating piece attached to or through the handle and front legs to allow a pivoting motion.

18: handle—Handle(s) with which a user may grip the cane chair.

20: armrest—Member that forms a connection between the rear legs and front legs.

22: armrest pin—Locating piece attached to or through the armrest and rear legs to allow a pivoting motion.

24: rear brace—Member(s) that form a connection between the rear legs.

26: sliding support—Pieces that slide along rear legs to allow the rear brace to move.

28: rear brace bar—Member that locks the rear brace and sliding supports.

30: lower brace pin—Locating piece attached to or through each rear leg for rear brace.

32: front brace—Member(s) that form a connection between the front legs.

34: front brace pin—Locating piece attached to or through each front leg for front brace.

36: seat—Piece that is attached to each seat bar for allowing the user to rest a portion or all of their weight.

38: backrest—Piece that is attached to each rear leg for allowing the user to rest a portion of their upper body weight.

40: seat closure—Piece(s) that are attached to the seat, allowing the seat to close around the folded cane chair.

FIGS. 1, 1A, 2, and 3—First Embodiment

Figure 1:
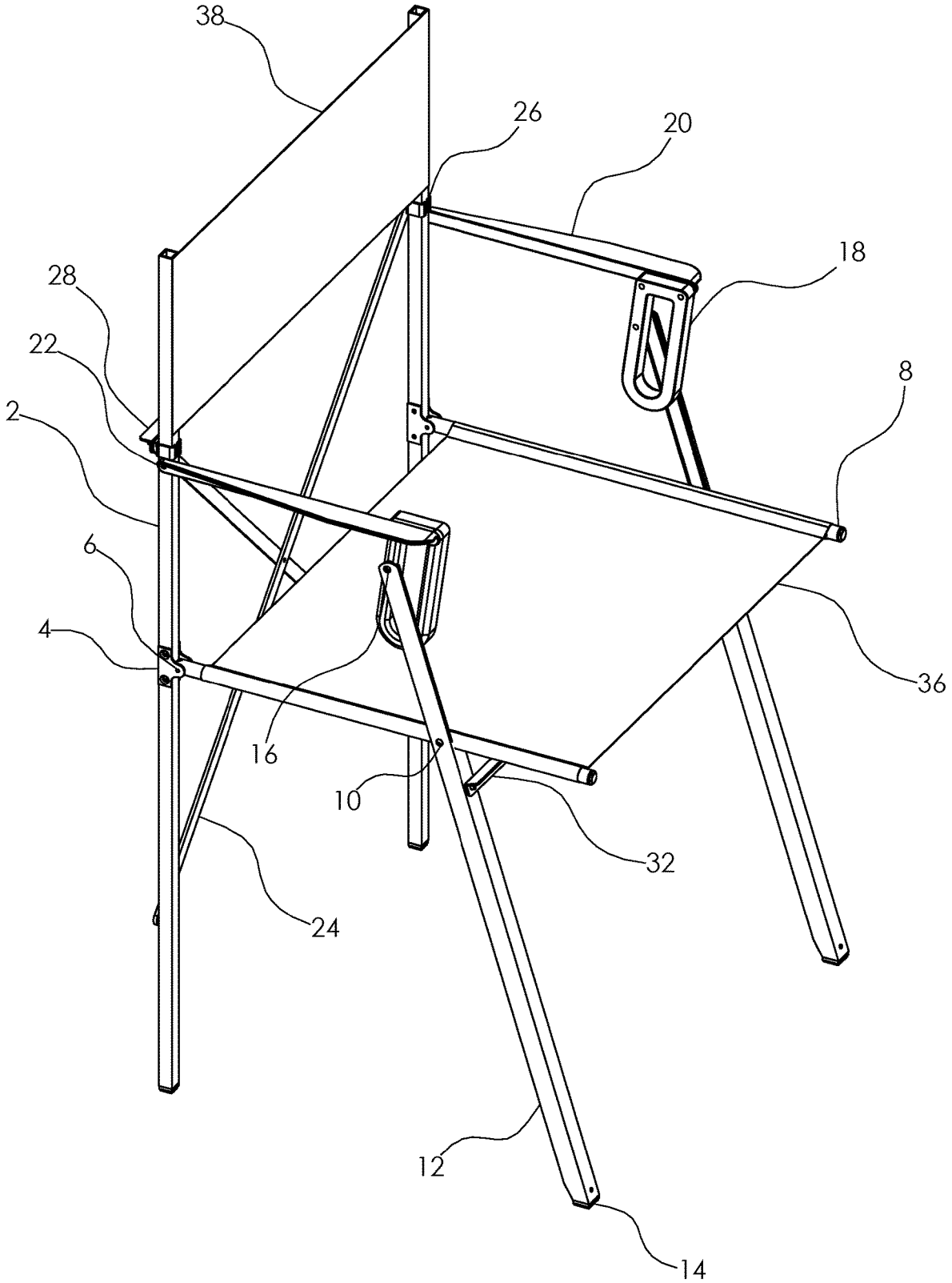
FIG. 1 shows an isometric view of the fully unfolded cane chair in accordance with one embodiment.
Figure 1A:
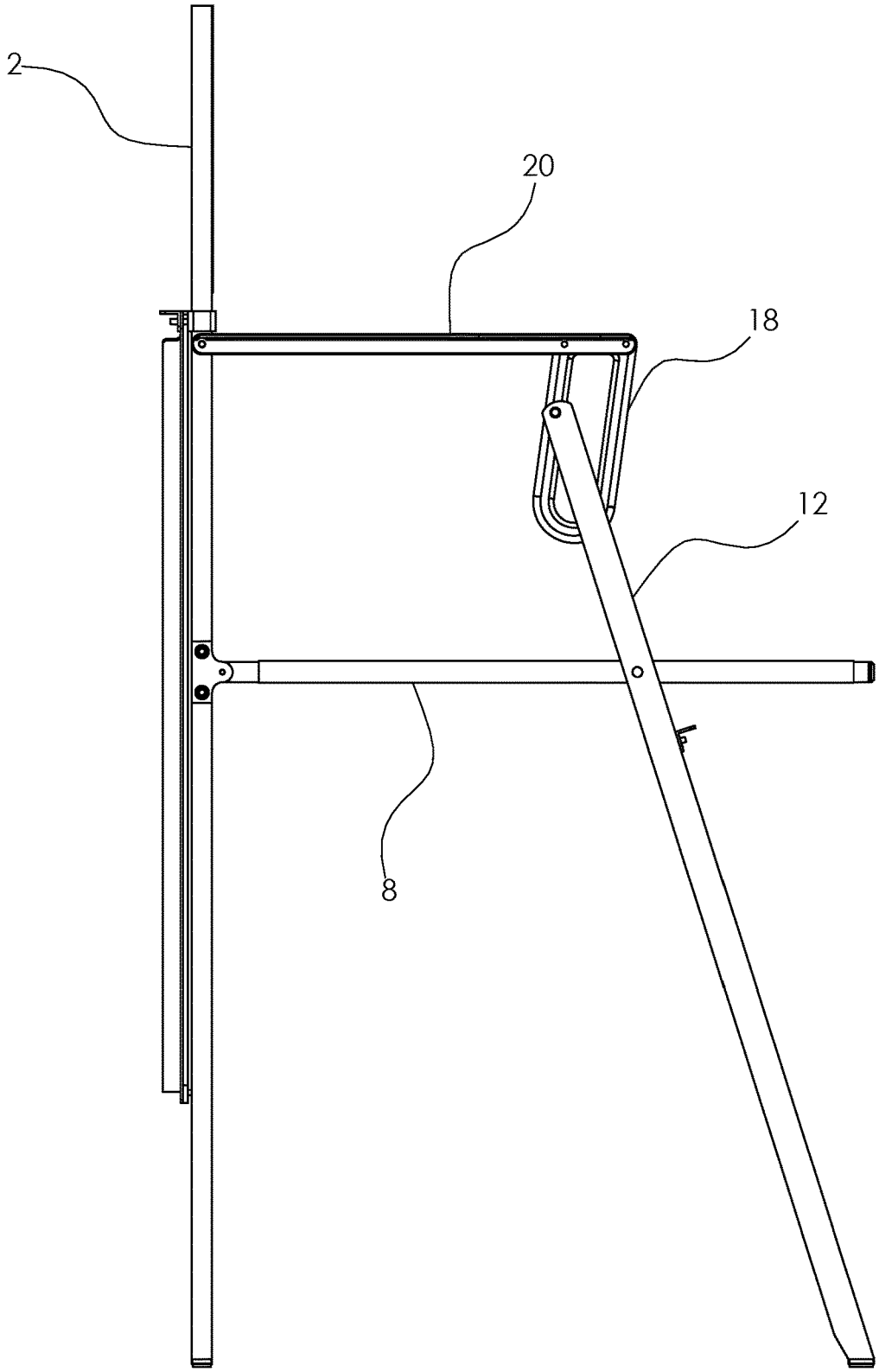
FIG. 1A shows a side view of the fully unfolded cane chair in accordance with one embodiment.
Figure 2:
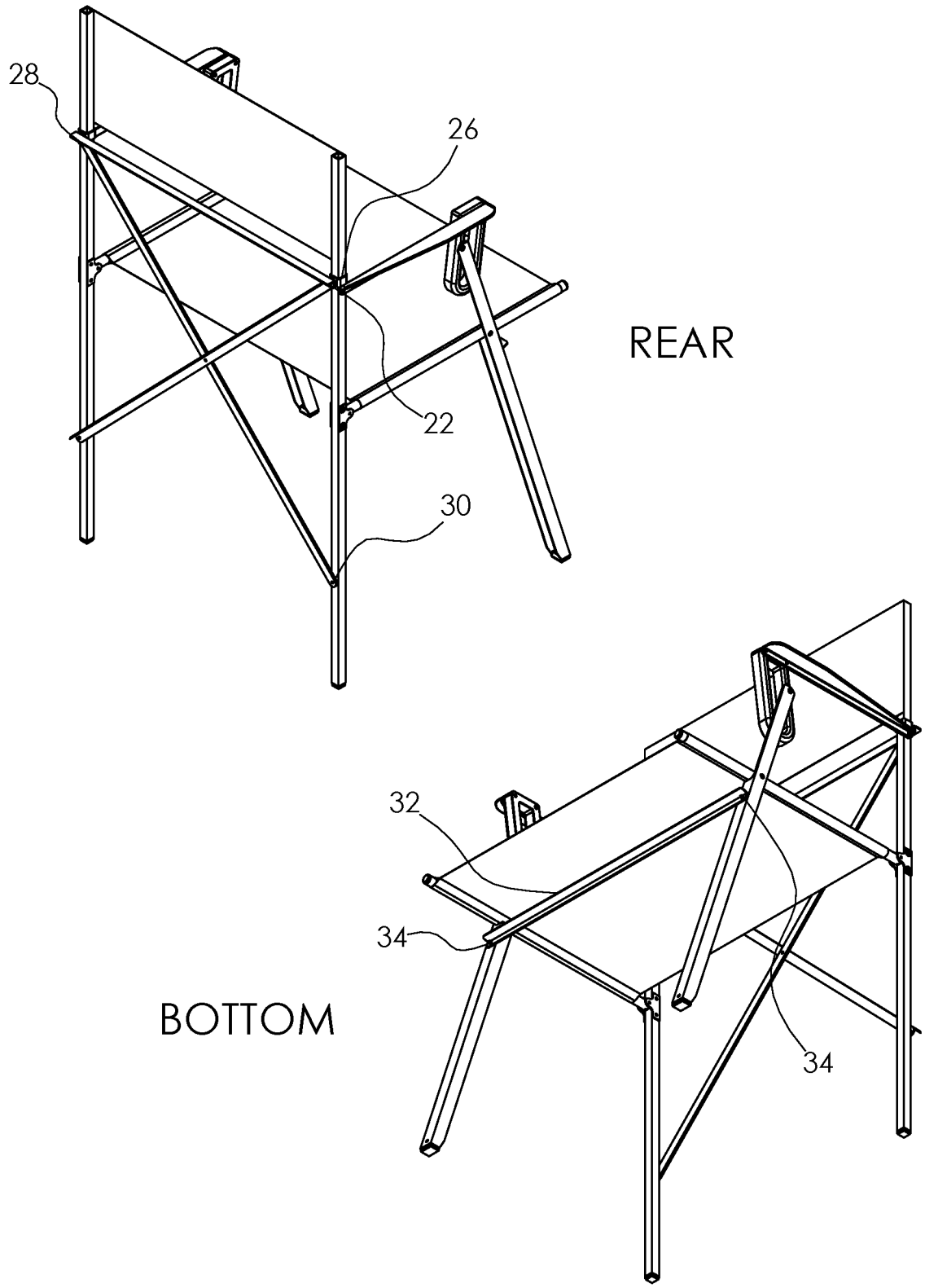
FIG. 2 shows unfolded rear and bottom views of the cane chair in accordance with one embodiment.
Figure 3:
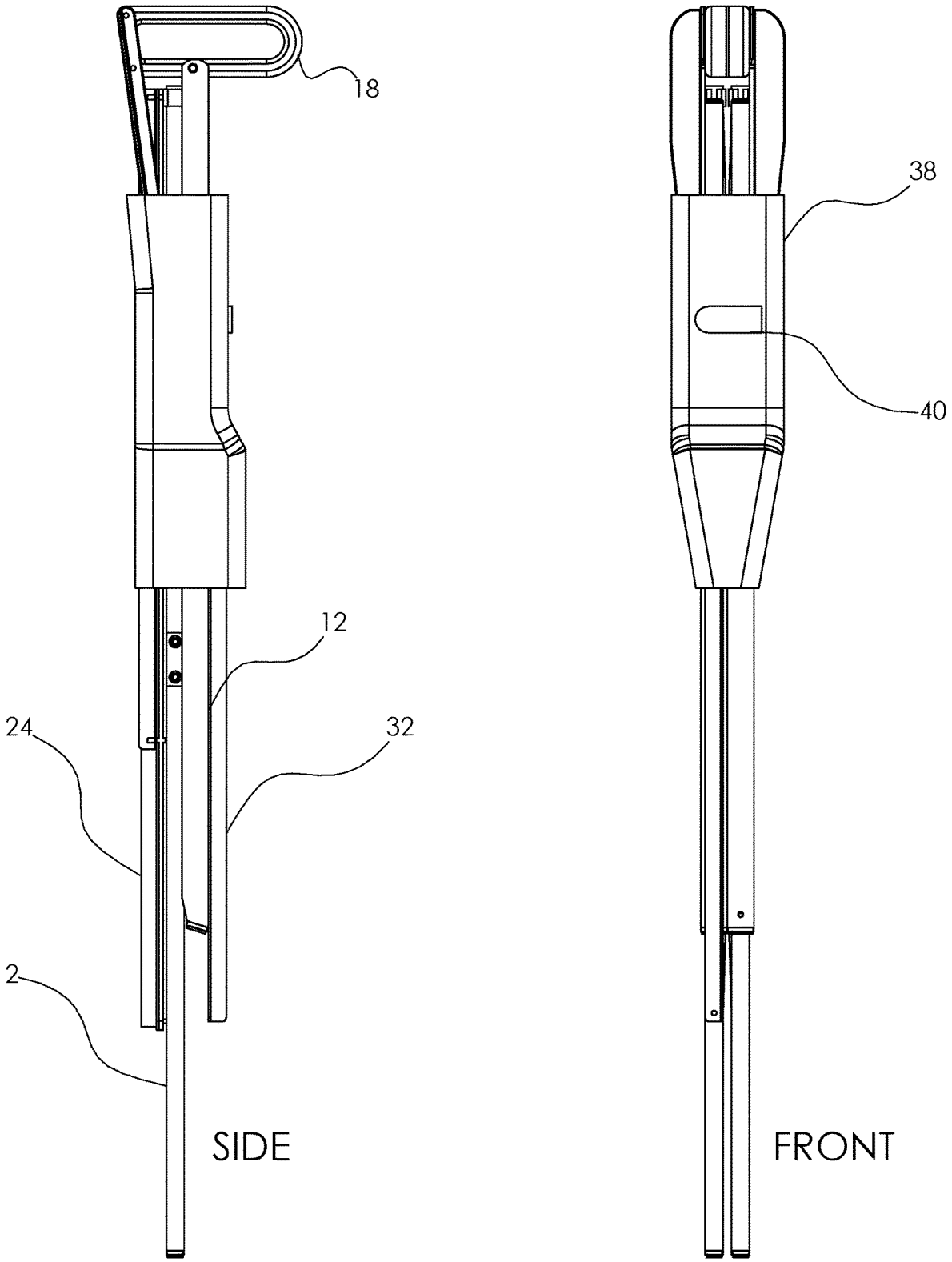
FIG. 3 shows folded side and front views of the cane chair in accordance with one embodiment.

One embodiment of the cane chair is shown in FIG. 1 (isometric view) as unfolded in the chair position. The cane chair is comprised of four legs, with two rear legs 2 lying approximately perpendicular to the floor when extended. These approximately 33" long rear legs 2 are of an aluminum hollow square cross section of 0.5"×0.5"×0.063". Although made of aluminum in this particular cross-section, other embodiments of the rear legs and other structural members and pieces that will be described can be made of any suitable structural material and cross-sectional shape to prevent undue stress and deformation. These materials may include steel alloys, magnesium, plastics and composites, etc. Furthermore, any material cross-sectional shape that accommodates the folding geometry may be used, including hollow or filled square, round, hexagonal, etc. Roughly midway between the top and bottom of the rear legs 2 are thin-gauge steel pivot brackets 4 through which ⅛" dia. steel press-fit bracket pins 6 locate and sandwich the aluminum round tube seat bars 8. The bracket pins in other embodiments may be made of other high tensile strength materials, and may be pins, shoulder screws, rivets, etc, and are not limited to one particular diameter. Approximately 10" away from the bracket pins 6 down the length of the seat bars 8 are ¼" steel seat pins 10 which slide through and rotate about the seat bars 8. The seat pins 10 slide through and locate a hole along the same direction as the bracket pins 6 in the aluminum front legs 12. The front legs 12 lie at an angle to the floor when the cane chair is unfolded, and are made of approximately 24.5" long, ¾" C-channel. A cutout in two sections of the channel allow the seat bar 8 to rest on the cutout when the cane chair is unfolded. When folded, the front leas 12 surround each respective seat bar 8 as shown in FIG. 3 to achieve the folded position in the same figure. At the bottom of both the rear legs 2 and front legs 12 are feet 14, which prevent the chair legs from moving relative to each other and the ground when the user is seated. At the top of each front leg is a ¼" steel handle pin 16, which is inserted through a hole in each front leg 12 and inserts into each handle 18, which rigidly connect to each aluminum L-angle armrest 20. When folded, as in FIG. 3, each handle 18 lies roughly perpendicular to the body of the cane chair. Each armrest 20 is approximately 11" long, and connects back to each rear leg 2 via armrest pins 22. The ⅛" steel armrest pins 22 locate and rotate about a hole in each rear leg 2 roughly between 7" and 9" above the seat pins 10. The angles and orientations of the unfolded members when viewed from the side as in FIG. 1A allow the cane chair to fold such that the members lie parallel to each other when folded as shown in the side view of FIG. 3. FIG. 2 shows isometric views of the cane chair from the rear and bottom. To prevent the sides of the cane chair from moving together when unfolded, an aluminum rear brace 24 connects to a sliding support 26 which slides on each rear leg 2. An aluminum rear brace bar 28 is pinned on one rear leg 2, and slides over another pin on the opposite rear leg 2 to add as another stiffening member between each cane chair side. The lower ends of the rear brace pivot around lower brace pins 30. An approximately 19" aluminum front brace 32 prevents the front legs 12 from moving inward when the user is sitting, with one end of the front brace 32 attached to a front brace pin 34. The other end of the front brace 32 slides over the other front brace pin 34, with both front brace pins 34 attached to each front leg 12. The seat 36 is made of a thin nylon fabric material that is wrapped and secured to be taut around both seat bars 8. The seat 36 extends nearly to each forward and rear end of the seat bar 8 to make a seating area with rough dimensions of 17"×14.5". Similarly, the backrest 38 is made of thin nylon fabric and extends to each left and right side of the cane chair, and is approximately 7" tall. Although made of nylon fabric in this embodiment, other embodiments may use another type of thin material or combination of materials that is easily pliable. The backrest 38 is affixed to each rear leg 2 at the top above the unfolded armrests 20. FIG. 3 shows the cane chair in the folded position, with the backrest 38 and seat 36 wrapped around the body of the folded cane, with the Velcro or other strap or button-type seat closure(s) 40 attaching the seat 36 to itself—thus preventing the cane chair from unwanted unfolding.

Operation

The operation for opening and closing the cane chair for the above embodiment begins with releasing the seat closure(s) 40 and loosening the seat 36 from its wrapped position around the closed cane chair. Once the seat 36 and backrest 38 are loose, the two cane chair sides can be pulled apart from each other, and do so along the track traced by the rear brace 24 and front brace 32—i.e. linear horizontal movement due to the X-brace in this embodiment. Once the desired width has been reached, the front brace 24 and rear brace 32 are locked into place by swiveling and positioning the ends over the respective pins on each leg.

With the cane chair now partially unfolded, it should be placed such that the user can reach the front legs 12. By keeping the rear legs 2 stationary, the front legs 12 can now be brought down to the floor to make the seat 36 and armrests 20 parallel or nearly parallel to the floor. Locking mechanisms can automatically or manually be put into place to prevent forward or backward swiveling movement, or the cane chair can be used without these. An alternative embodiment may use one or more manual, mechanical, or electronic assisted movements to simultaneously open all four legs at once, in sequence, or in partial sequence.

Closing the cane chair to take the folded form follows a similar pattern to the unfolding, but uses a reverse order of operations. Locking the members to prevent unfolding can use latches, locks, etc. In this embodiment, the seat 36 and backrest 38 are wrapped around the legs, armrests 20, and seat bars 8 and strapped to itself using the seat closure(s) 40 to keep the cane chair from unwanted unfolding.

FIGS. 4-8—Alternative Embodiments

Figure 4:
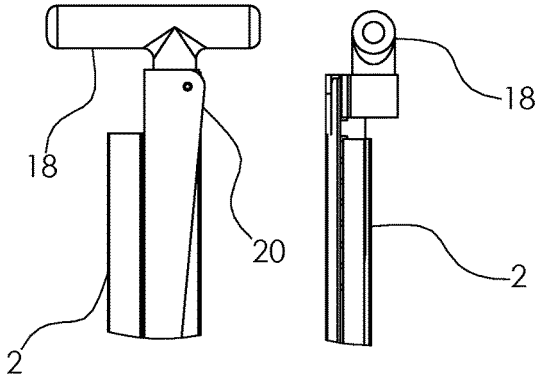
FIG. 4 shows a folded side and front view of a single handle piece and alternative pivot mount for the front legs in accordance with other embodiments.
Figure 5:
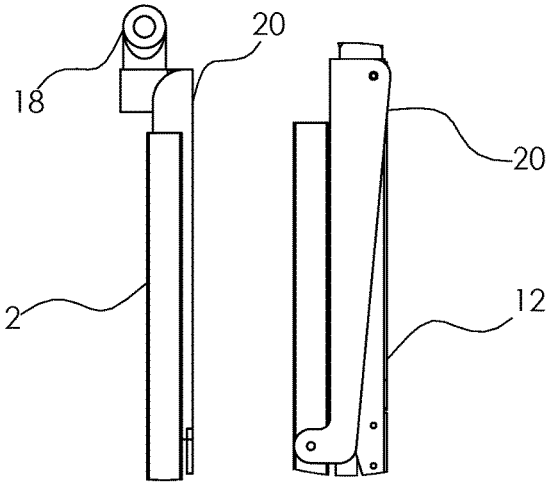
FIG. 5 shows a folded side and front view of an armrest assembly where the flat of the armrest is sandwiched between the rear leg and seat bar in accordance with other embodiments.
Figure 6:
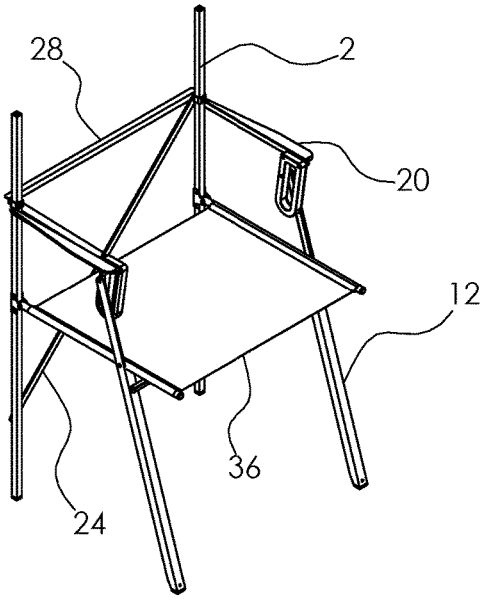
FIG. 6 shows an unfolded view of the cane chair without a backrest in accordance with one embodiment.
Figure 7:
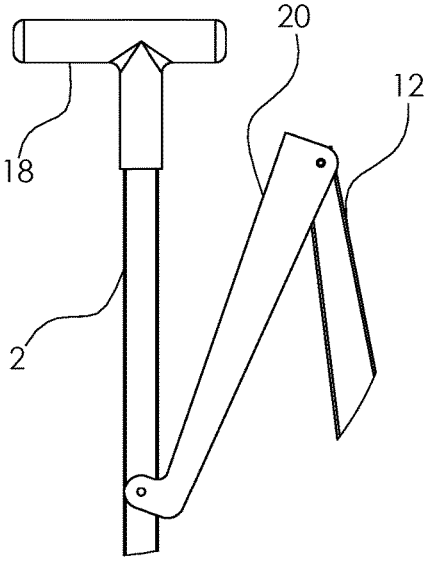
FIG. 7 shows a partially unfolded side view of the cane chair where the handle is attached to the rear leg in accordance with other embodiments.
Figure 8:
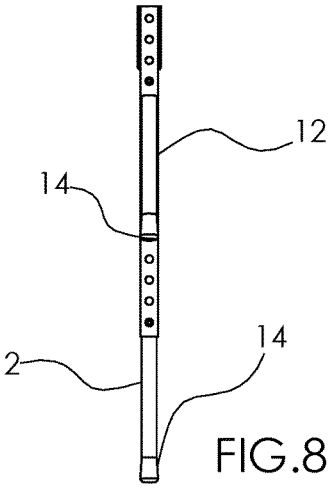
FIG. 8 shows a partially unfolded front view of the cane chair where the rear and front legs, or either pair, have extendable legs in accordance with other embodiments.

A number of alternative embodiments are shown in FIGS. 4-8. In FIG. 4, the armrests and front leg pivot points are one piece with the handle attached to the armrest on one side of the cane chair. In FIG. 5, the armrests are tucked into the body of the folded cane chair and are sandwiched between the seat bars and the rear legs, with either a single- or multi-piece handle assembly. In FIG. 6, the backrest is omitted. In FIG. 7, the handle is attached to one or more rear legs. In FIG. 8, the height of the legs is adjustable in lieu of fixed-length legs. Operation in alternative embodiments follows that of the first embodiment or its derivatives.

Advantages

A variety of advantages can be seen from the above description of one or more embodiments as listed below:

(a) The use of the shown folding geometry allows for conventional chair and cane functions that can be accomplished using a small folded shape.

(b) By using a large base perimeter created with the legs at the floor in combination with a large seat, the cane chair is both stable when unfolded and easy to sit on.

(c) The armrests provide a way to lower one's self down into the chair from the prostrate position, and make it possible to have arm support in a portable seating device.

(d) Handles allow the cane chair to be used as a walking or standing aide, and the seat that folds out from the cane chair permits portable seating for a variety of users.

(e) The construction of the cane chair makes it possible for a lightweight design, which increases portability and usability for a variety of users.

(f) The design and geometry can be adapted to fit a variety of ages and requirements; by scaling the dimensions appropriately, the cane chair is suitable for small children to large adults.

CONCLUSION

The reader may see that this cane chair is made for safety, comfort, and ease of use. By using a seat and base of a similar large size, the user can feel like they are using a normal chair. The portability of the folded cane chair in dimensions, weight, and aesthetics are an added advantage. Furthermore, the cane chair in other embodiments may be made smaller or larger in size, be made of a variety or mixture of materials, and have the folding geometry adjusted as well. The presented description describes many specific attributes, but should not be construed as the limitation on scope of the embodiments, but rather a sample of possible embodiments. For example, the sliding mechanism on the rear legs could be replaced by a sliding bar that slides and is captured by the interior of the rear legs. By doing this, the rear brace could be collapsed into the rear legs when folded. Additionally, the rear brace bar could be changed or eliminated altogether. The handle could also be removed and the cane chair could be used as a slim, portable chair. Added protrusions near the bottom of the rear legs could be attached to the rear legs such that in the folded state there would appear to be no dissimilarity in the front and rear legs heights.

Many modifications and other embodiments of the disclosure set forth herein will come to mind to one skilled in the art to which these embodiments pertain having the benefit of teachings presented in the foregoing descriptions and the associated figures. Although the figures only show certain components of the apparatus and systems described herein, it is understood that various other components may be used in conjunction with the system. Therefore, it is to be understood that the disclosure is not to be limited to the specific embodiments disclosed and that modifications and other embodiments are intended to be included within the scope of the appended claims. For example, the various elements or components may be combined, rearranged, or integrated in another system or certain features may be omitted or not implemented. Moreover, the steps in any method described above may not necessarily occur in the order depicted in the accompanying figures, and in some cases one or more of the steps depicted may occur substantially simultaneously, or additional steps may be involved. Although specific terms are employed herein, they are used in a generic and descriptive sense only and not for purposes of limitation.

I claim:

1. A foldable chair comprising: a pair of rear legs each having a first end and a second end; a pair of front legs each having a first end and a second end; a pair of elongated seat bars each having a first end and a second end extending along an axis, each of said first ends pivotally connected to a respective one of said rear legs, a point along the axis pivotally connecting to said front legs between the first end and second end; a plurality of elongated armrest pieces each with a first end and second end, the first end of each elongated armrest piece pivotally attached to a respective one of said rear legs between their first end and second end, said second end of each elongated armrest piece pivotally connected to the second end of each front leg such that when each elongated armrest piece is perpendicular to a respective one of said rear legs the elongated seat bars are parallel to the elongated armrest pieces, and the front legs are approximately parallel to the rear legs; one or more bracing members connecting said rear legs such that said rear legs may move linearly with respect to each other, and that the axes of the rear legs remains in the same orientation but the distance between the rear legs may vary and be locked or unlocked in a position; one or more bracing members connecting said front legs such that said front legs may move with respect to each other, and that the distance between the front legs may vary and be locked or unlocked in a position; a seat that connects to said elongated seat bars; and one or more handles acting as a hand support for a user, such that each said handle is attached and positioned perpendicular to and near the second end of each respective elongated armrest piece, wherein a portion of said handles are further positioned directly adjacent to each other and are nested between the elongated armrest pieces when said foldable chair is configured in a compact bundle.

2. The foldable chair of claim 1 wherein one or more of said rear legs or said front legs include telescoping appendages.

3. The foldable chair of claim 1 wherein a flexible backrest connects to each of said pair of rear legs near the second ends.

4. A foldable chair comprising: a pair of rear legs each having a first end and a second end; a pair of front legs each having a first end and a second end; a pair of elongated seat bars each having a first end and a second end extending along an axis, each of said first ends pivotally connected to a respective one of said rear legs, a point along the axis pivotally connecting to said front legs between the first end and second end; a plurality of elongated armrest pieces each with a first end and second end, the first end of each elongated armrest piece pivotally attached to a respective one of said rear legs between their first end and second end, said second end of each elongated armrest piece pivotally connected to the second end of each front leg such that when each elongated armrest piece is perpendicular to a respective one of said rear legs the elongated seat bars are parallel to the elongated armrest pieces, and the front legs are approximately parallel to the rear legs; one or more bracing members connecting said rear legs such that said rear legs may move linearly with respect to each other, and that the axes of the rear legs remains in the same orientation but the distance between the rear legs may vary and be locked or unlocked in a position; one or more bracing members connecting said front legs such that said front legs may move with respect to each other, and that the distance between the front legs may vary and be locked or unlocked in a position; a seat that connects to said elongated seat bars; wherein the foldable chair is configured to fold into a compact bundle that may be used as a walking or standing implement wherein in said compact bundle said rear legs, front legs, elongated seat bars, elongated armrest pieces, bracing members, and seat being arranged such that said rear legs, front legs, and elongated seat bars lie parallel and directly adjacent to each other, and the elongated armrest pieces are positioned nearly parallel to the rear legs; and one or more handles acting as a hand support for a user, such that each said handle is attached and positioned perpendicular to and near the second end of each respective elongated armrest piece, wherein a portion of said handles are further positioned directly adjacent to each other and are nested between the elongated armrest pieces above the rear legs when the foldable chair is configured in said compact bundle.

5. The foldable chair of claim 4 wherein the seat wraps around exterior surfaces of said compact bundle and is attached to itself using a seat closure made from hook-and-loop material.

6. The foldable chair of claim 4 wherein one or more of said rear legs or said front legs include telescoping appendages.

7. The foldable chair of claim 4 wherein a flexible backrest connects to each of said pair of rear legs near the second ends.

* * * * *